US006206593B1

(12) United States Patent
Brenner et al.

(10) Patent No.: US 6,206,593 B1
(45) **Date of Patent: *Mar. 27, 2001**

(54) COMPUTER WITH ATTACHED PRINTER

(75) Inventors: Richard K Brenner, Fanwood, NJ (US); Mark S. Kimbrough, Austin, TX (US); Philip Leung, Heaton (GB); Robert H. Garrett, Austin, TX (US); Pearce Jones, Austin, TX (US); Christopher A. Cogburn, Austin, TX (US)

(73) Assignee: Brother International Corporation, Somerset, NJ (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/585,560

(22) Filed: Jan. 16, 1996

(51) Int. Cl.[7] ..... B41J 29/02
(52) U.S. Cl. ..... 400/693; 400/680; 361/680
(58) Field of Search ..... 400/83, 680, 691, 400/692, 693; 361/680, 681

(56) References Cited

U.S. PATENT DOCUMENTS

| | | | | |
|---|---|---|---|---|
| 4,790,431 | * | 12/1988 | Reel et al. | 400/613.2 |
| 4,808,017 | | 2/1989 | Sherman et al. | 400/83 |
| 4,808,800 | | 2/1989 | Nishijima et al. | 235/58 CF |
| 4,837,590 | * | 6/1989 | Sprague | 400/83 |
| 4,851,812 | * | 7/1989 | Holmberg | 400/680 |
| 4,859,092 | * | 8/1989 | Makita | 400/83 |
| 4,883,376 | | 11/1989 | Iwase et al. | 400/83 |
| 4,946,300 | * | 8/1990 | Makita | 400/680 |
| 5,021,984 | | 6/1991 | Meade et al. | 364/709.16 |
| 5,047,615 | | 9/1991 | Fukumoto et al. | 235/432 |
| 5,214,574 | * | 5/1993 | Chang | 400/691 |
| 5,229,921 | * | 7/1993 | Bohmer | 400/680 |
| 5,275,494 | * | 1/1994 | Petracca et al. | 400/83 |
| 5,308,174 | * | 5/1994 | Kuki | 400/83 |
| 5,345,403 | | 9/1994 | Ogawa et al. | 364/708.1 |
| 5,364,196 | * | 11/1994 | Baitz | 400/680 |
| 5,475,413 | * | 12/1995 | Hashimoto et al. | 400/680 |
| 5,560,719 | * | 10/1996 | Ballard et al. | 400/83 |
| 5,646,872 | * | 7/1997 | Yonenaga et al. | 400/83 |

* cited by examiner

*Primary Examiner*—Ren Yan
(74) *Attorney, Agent, or Firm*—Oliff & Berridge, PLC

(57) ABSTRACT

An information device having a printer includes a body and a printer portion for housing the printer and a printing medium. The body has a display screen side in which a display screen is positioned and a printer side positioned opposite the display screen side. The printer portion is attached to the printer side of the body such that the printer portion remains concealed during operation of the printer when the information device is viewed from the display screen side.

19 Claims, 21 Drawing Sheets

COMPUTER WITH ATTACHED PRINTER

BACKGROUND OF THE INVENTION

1. Field of the Invention

The present invention relates to a computer, and in particular, to a computer with an attached printer.

2. Related Applications

This invention is related to the inventions described in and claimed in pending U.S. patent applications (Attorney Docket Nos. JAO 30911, JAO 30912, JAO 30914, JAO 30915, JAO 30916, JAO 30917 and JAO 30918), filed on the same day as this application, which are hereby incorporated by reference.

3. Description of Related Art

Information devices having attached printers are known. For example, U.S. Pat. No. 4,808,017 to Sherman et al. discloses a typewriter having a pivotable lid on which a display screen is positioned such that the display screen is visible above the printing portion of the typewriter.

U.S. Pat. No. 4,808,800 to Nishijima et al. discloses a calculator having an attached printer through which paper from a roll is fed before the paper exits through an opening in a top surface of the calculator.

U.S. Pat. No. 5,047,615 to Fukumoto et al. discloses a bar code printing and reading apparatus. The bar code printing and reading apparatus includes a printer portion through which paper is fed in an upward direction before the paper exits through an opening in a top surface of the printer portion.

U.S. Pat. No. 4,883,376 to Iwasi et al. discloses a data processing apparatus with a printer. The printer, which is of the impact type, is positioned rearward of the display screen. The printer prints individual sheets of paper that are inserted into and exit from a paper opening in a top surface of the data processing apparatus.

U.S. Pat. No. 5,345,403 to Ogawa et al. discloses an information processing apparatus and printer. The printer is positioned rearward of the display screen. A sheet of paper are inserted from a front side into a slot in the display screen. The printed sheet exits the slot from a rear side opposite the front side. The printer is detachable from the information processing apparatus.

None of the prior art devices provide a printer that remains concealed from view during operation when the computer is viewed from a display screen side. As a result, the prior art printers remain exposed to any adverse environmental conditions of the workplace. Furthermore, the printers of the prior art devices change the configuration of the front sides of those devices.

SUMMARY OF THE INVENTION

An object of the present invention is to provide a information device having an attached printer that overcomes the problems of the prior art devices. According to one embodiment, the information device having an attached printer includes a body and a printer portion for housing the printer and a printing medium. The body includes a display screen side in which a display screen is positioned and a printer side positioned opposite the display screen side. The printer portion is attached to the printer side of the body such that the printer portion and the printing medium remain concealed during operation of the printer when the information device is viewed from the display screen side.

Preferably, the printer portion includes a movable upper section and a stationary lower section. The printing medium is preferably paper wound into a paper roll, and the printer portion is preferably configured to hold the paper roll such that it is rotable on a paper roll axis. In a preferred embodiment, the upper section includes an exit opening through which the printing medium exits. In addition, the upper section preferably includes a feed button actuatable to feed the printing medium through the printer.

In a preferred embodiment, the upper section includes a printing mechanism of the printer. Preferably, the printing mechanism is a thermal-type printing mechanism, and the printing medium is heat-sensitive paper. Preferably, the printer mechanism is operatively connected to a controller of the information device by a flexible connection link.

In a preferred embodiment, the upper section is pivotable about a pivot point on the lower section between a first position and a second position. The upper section preferably includes an upper section release button actuatable to release the upper section from first position.

The upper section in the first position preferably extends upward at an angle to a vertical direction. The upper section in the first position preferably defines a direction of a pre-printing feed path of the printing medium from the lower section to the upper section of the printer portion. The rear surface of the upper section preferably includes an exit opening through which the printing medium exits. The direction of the exit opening preferably defines a post-printing feed path of the printing medium that intersects the pre-printing feed path at an angle. In a preferred embodiment, when the upper section is in the second position, a paper roll is exposed.

In a preferred embodiment, the body has a first width and the printer portion has a second width, the second width being less than the first width. Preferably, the body has a first vertical dimension defined by a distance between a bottom surface and an uppermost surface of the body and the printer portion has a second vertical dimension defined by a distance between a bottom surface and an uppermost surface of the printer. The second vertical dimension is less than the first vertical dimension.

According to another embodiment, the information device having a thermal printer for printing paper supplied from a paper roll includes a body and a printer portion. The body includes a display screen side in which a display screen is positioned and a keyboard storage side having a keyboard storage portion shaped to at least partially receive the keyboard. The printer portion that encloses the printer and the paper roll is attached to the keyboard storage side of the body. As a result, a profile of the body is greater than a profile of the printer portion from the display screen side such that the printer portion is concealed from view.

According to another embodiment, the invention includes a control system for an information device connected to a printer. The device includes a memory for storing at least one data file and a controller for selectively reading the data file stored in memory. With respect to the data file selectively read by the controller, a display screen displays the data file itself or a designation for the data file. A dedicated printer switch connected to the controller can be closed to interrupt operation of the controller and print the entire data file displayed or designated on the display screen. Preferably, the print control element is a plunger-type switch connectible to a printer. The print control element is preferably disposed on a display screen side of the information device.

BRIEF DESCRIPTION OF THE DRAWINGS

The preferred embodiments of this invention will be described in detail, with reference to the following figures, wherein.

DETAILED DESCRIPTION OF PREFERRED EMBODIMENTS

Figure 1:
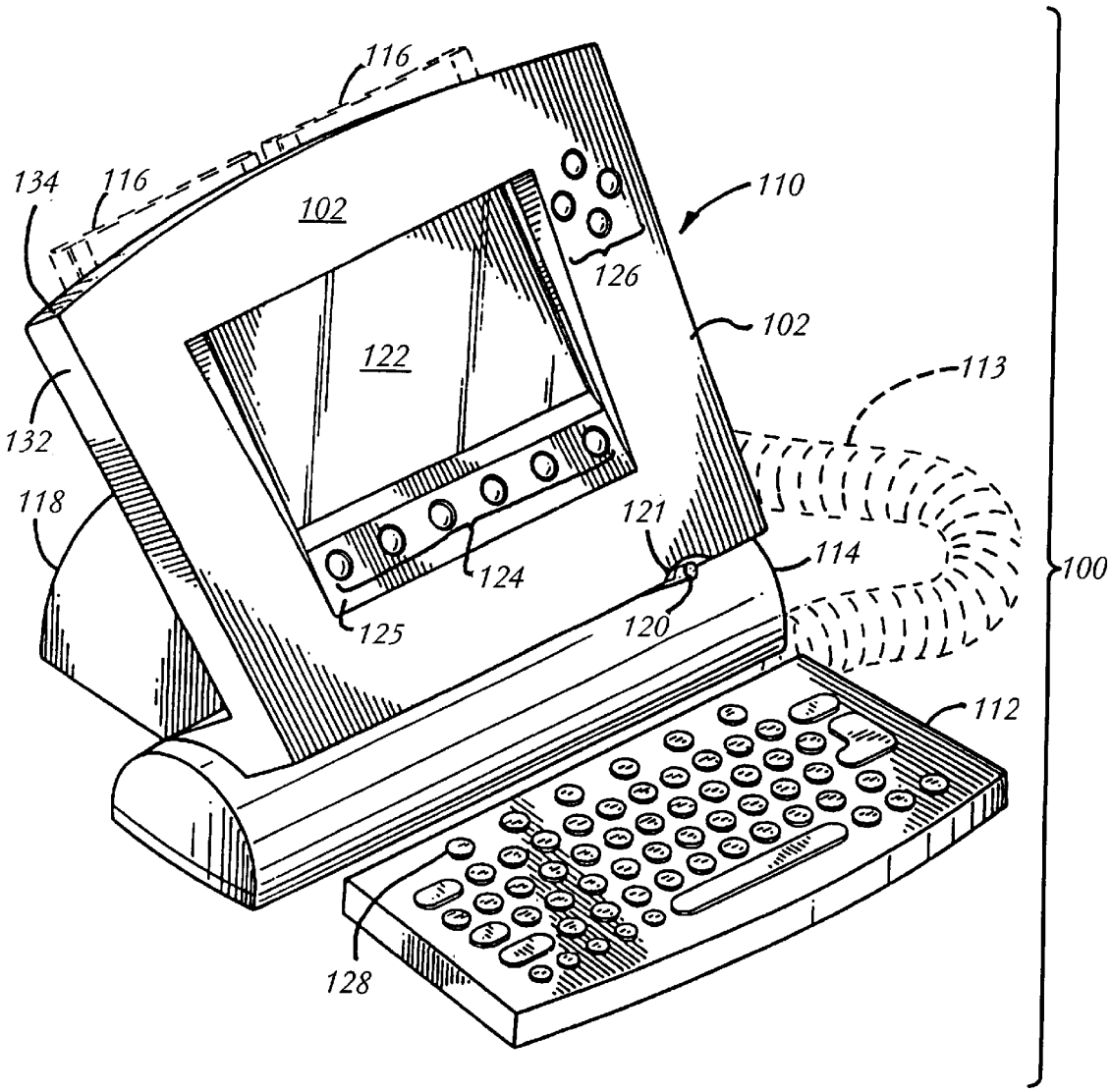
FIG. 1 is a front perspective view of the computer with a keyboard in an operating position showing two IC data cards installed in ports on a top surface of the computer.
Figure 27:
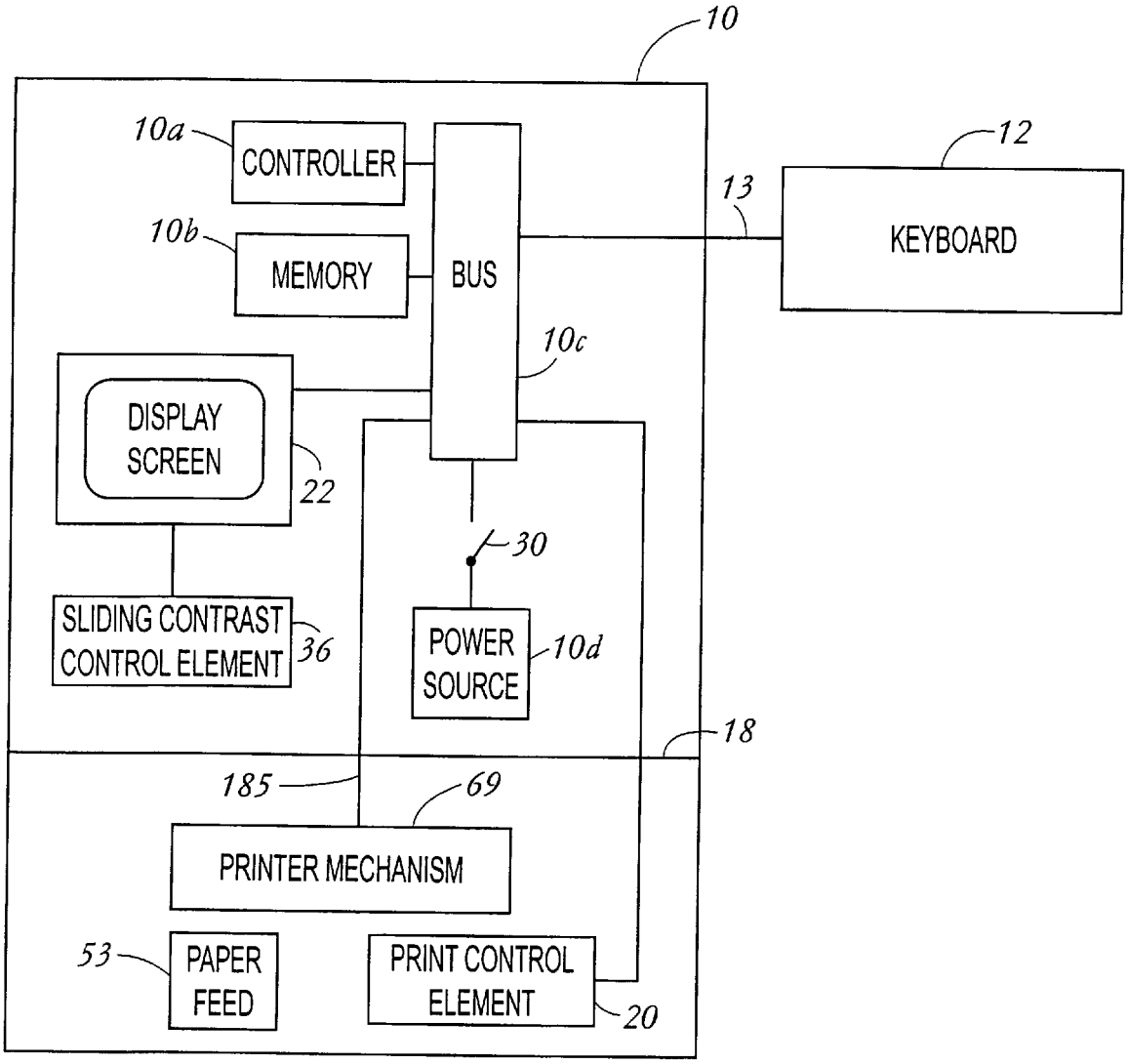
FIG. 27 is a block diagram of the electrical components of the computer, keyboard and printer.

FIGS. 1–7 illustrate a computer 100, having a housing 110, a keyboard 112 and an attached printer 118. As shown in block diagram form in FIG. 27, the control system 200 of the computer 100 includes a controller 210, a memory 220 and a bus 230 interconnecting the controller 210 and the memory 230. The bus 230 of the computer 100 is connected to an AC or a DC power source 240 that supplies power to the control system 200 when a power switch 130 is in an "ON" position. As shown in FIG. 1, the keyboard 112 is connected to the housing 110 of the computer 100 by a flexible keyboard connecting cord 113. As shown in FIG. 27, the connecting cord 113, electrically connects the keyboard 112 to the bus 230. For clarity, the keyboard connecting cord 113 is not shown in the other figures.

As shown in FIG. 27, the controller 210 is preferably implemented on a programmed microprocessor or microcontroller and peripheral integrated circuit elements. However, the microcontroller 210 can also be implemented on an ASIC or other integrated circuit, a hardwired electronic or logic circuit such as a discrete element circuit, a programmable logic device such as a PLD, PLA or PAL, or the like.

Figure 2:
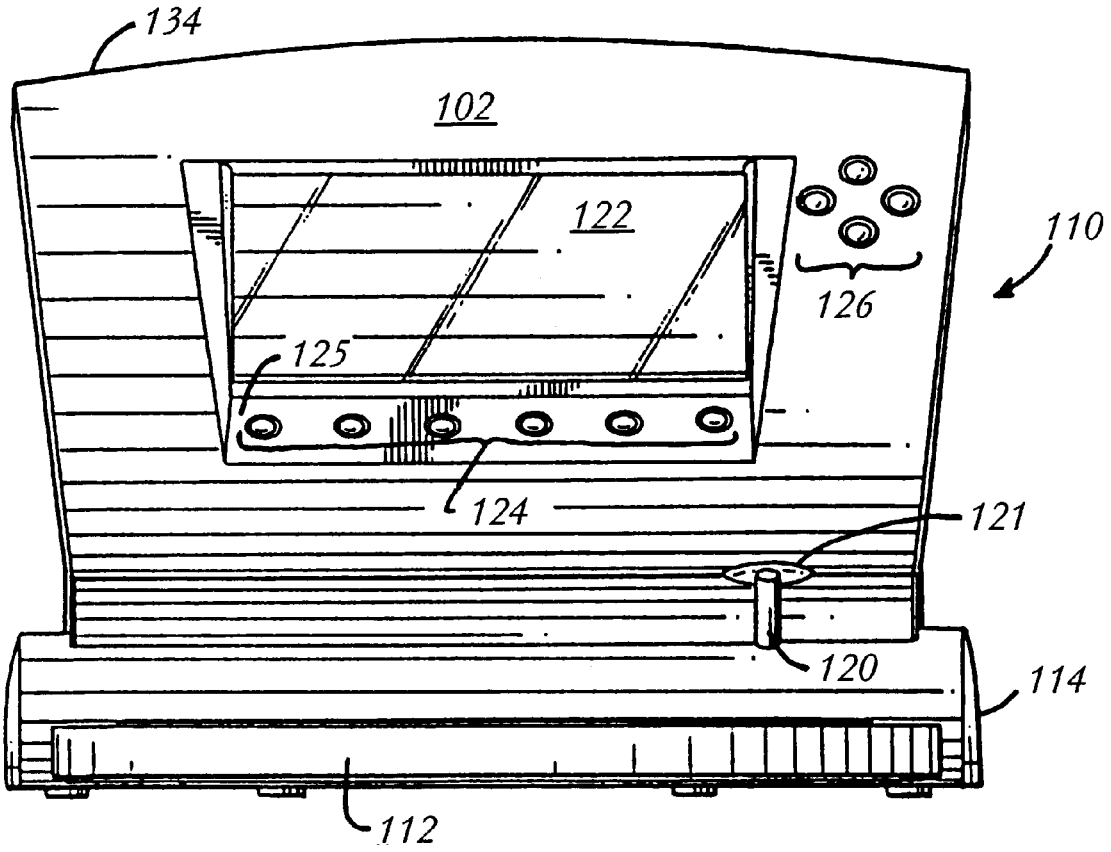
FIG. 2 is a front view of the computer and keyboard of FIG. 1.
Figure 3:
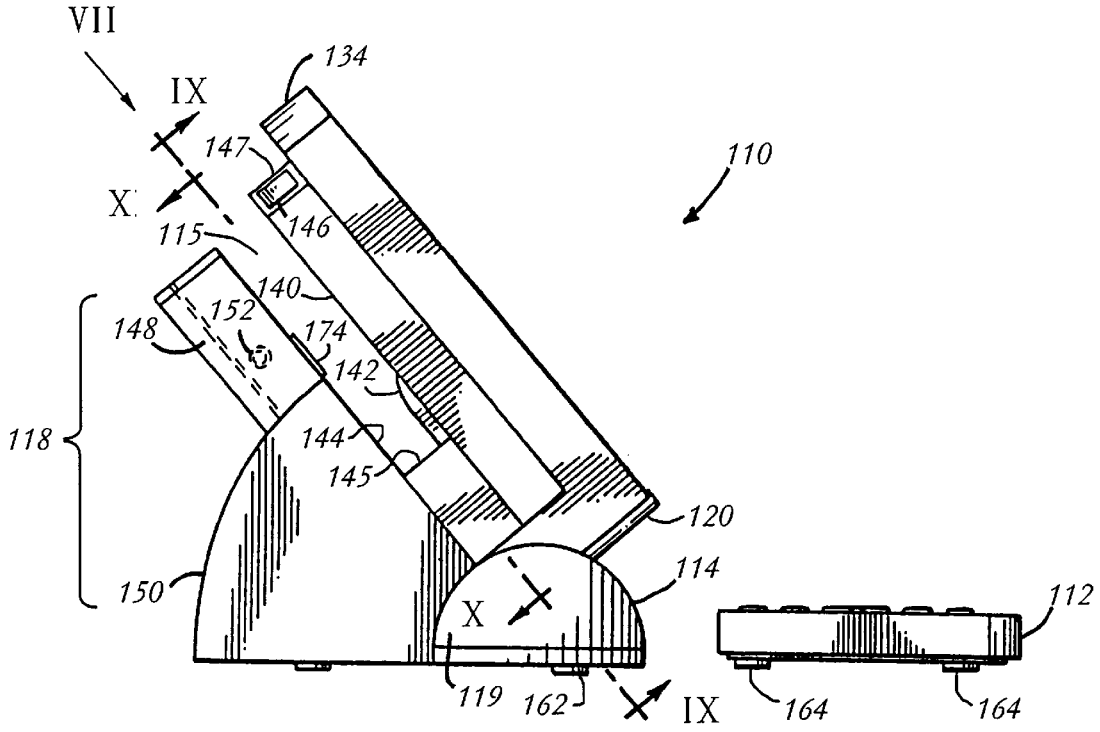
FIG. 3 is a left side view of the computer and keyboard of FIG. 1.
Figure 4:
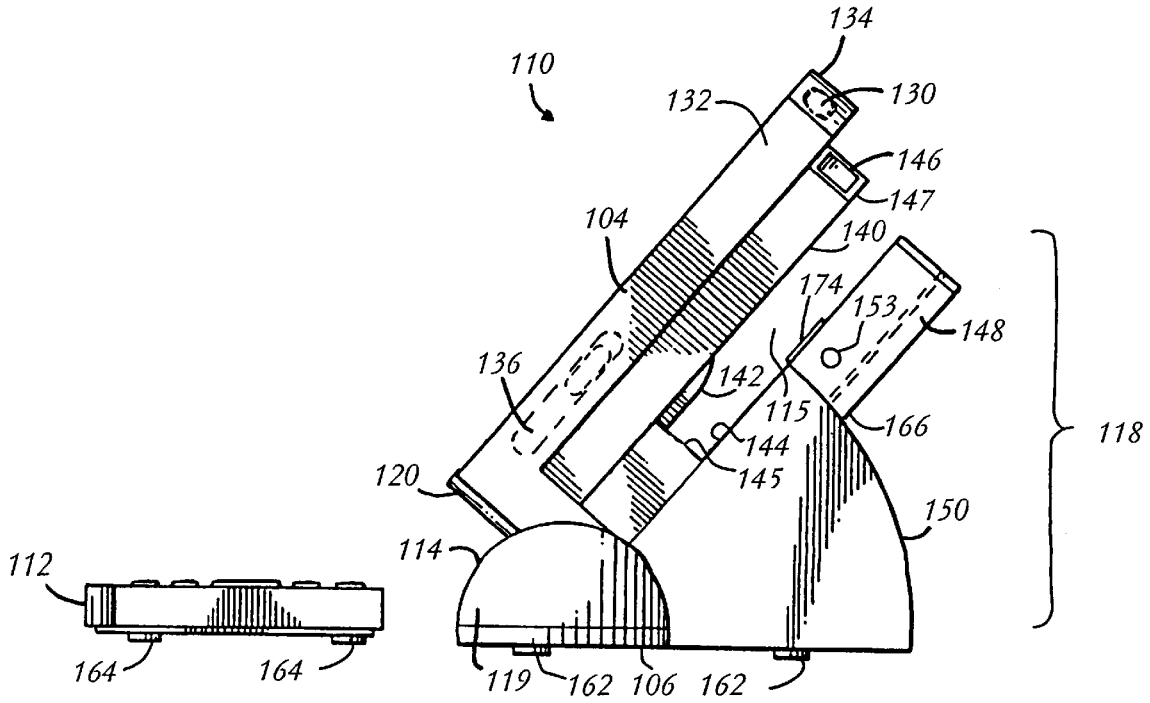
FIG. 4 is a right side view of the computer and keyboard of FIG. 1.

The computer 100 includes a display screen 122 disposed on a front surface 102 of a display screen portion 132. The display screen 122 is preferably a liquid crystal display, although other types of display screens can be used. As shown in FIG. 4, the display screen 122 can be adjusted using a display screen contrast control element 136 disposed on a left side surface 104 of the display screen portion 132. The display screen portion 132 projects rearwardly from a base 114 at a predetermined angle with respect to the bottom surface 106 so that the display screen is visible to and optimally positioned for a seated or standing user. Alternatively, the display screen portion 132 can be attached to the base 114 by a hinge (not shown) to allow the angular position of the display screen portion 132 to be adjusted for easy viewing of the display screen 122. A width of the base 114, as shown in FIG. 2, is slightly greater than the width of the display screen portion 132. The sides 119 of the base 114, as shown in FIGS. 3 and 4, have an approximately semicircular shape.

The display screen portion 132 includes display screen cursor movement keys 126. Preferably, as shown in FIG. 1, there are four screen cursor movement keys. The display screen cursor movement keys 126 are positioned adjacent to an upper right corner of the display screen 122 and are placed in a diamond-shaped pattern. Each of the display screen cursor movement keys 126 moves the cursor in a direction corresponding to the position of the key within the diamond-shaped pattern. Therefore, the upper display screen cursor movement key moves the cursor upward, the right display screen cursor movement key moves the cursor to the right, the lower display screen cursor movement key moves the cursor downward and the left display screen cursor movement key moves the cursor to the left. Of course, other devices for moving the display screen cursor can be used. These other devices include a mouse-type track ball. The display screen portion 132 includes a display screen panel 125 within which multiple display screen function keys 124 are disposed. In a preferred embodiment, the display screen function keys 124 are evenly spaced in a horizontal array. In the preferred embodiment, the program executed by the control system 200 assigns different functions to the display screen function keys 124 depending upon the portion of the program currently being executed.

The keyboard 112 includes a corresponding array of keyboard function keys 128 having the same functions as the display screen function keys 124. The display screen function keys 124 and the keyboard function keys 128 are preferably the same in number, size, color, feel, spacing, etc. Thus, a user can easily determine which function key is desired from either array, whether both the keyboard function keys 128 and the display screen function keys 124 or only the display screen function keys 124 are accessible and/or visible to the user.

As described above, the function assigned to each of the display screen function keys 124 and each of the corresponding keyboard function keys 128 changes during execution of the program by the control system 200. The current function assigned to each function key is preferably displayed on the display screen 122 directly above each one of the corresponding display screen function keys 124. Alternatively, both the display screen function keys 124 and the keyboard function keys 128 can be dedicated to serve the same functions at all times. In other aspects, the keyboard 112 is similar to those known in the art. If the keyboard 112 is intended for use with a computer for processing information relating to food preparation, the keyboard preferably includes dedicated keys for specifying and/or converting between various units of measure (not shown).

Figure 7:
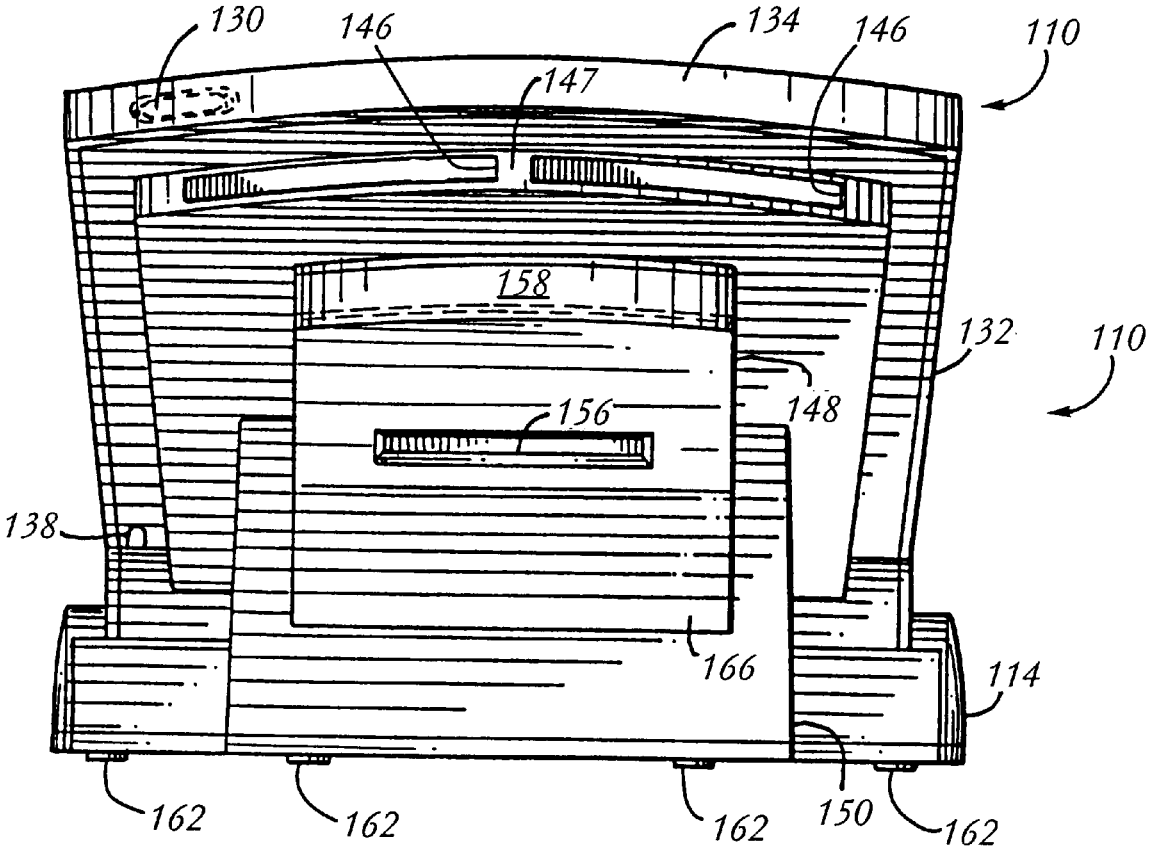
FIG. 7 is a rear view of the computer of FIG. 1.
Figure 8:
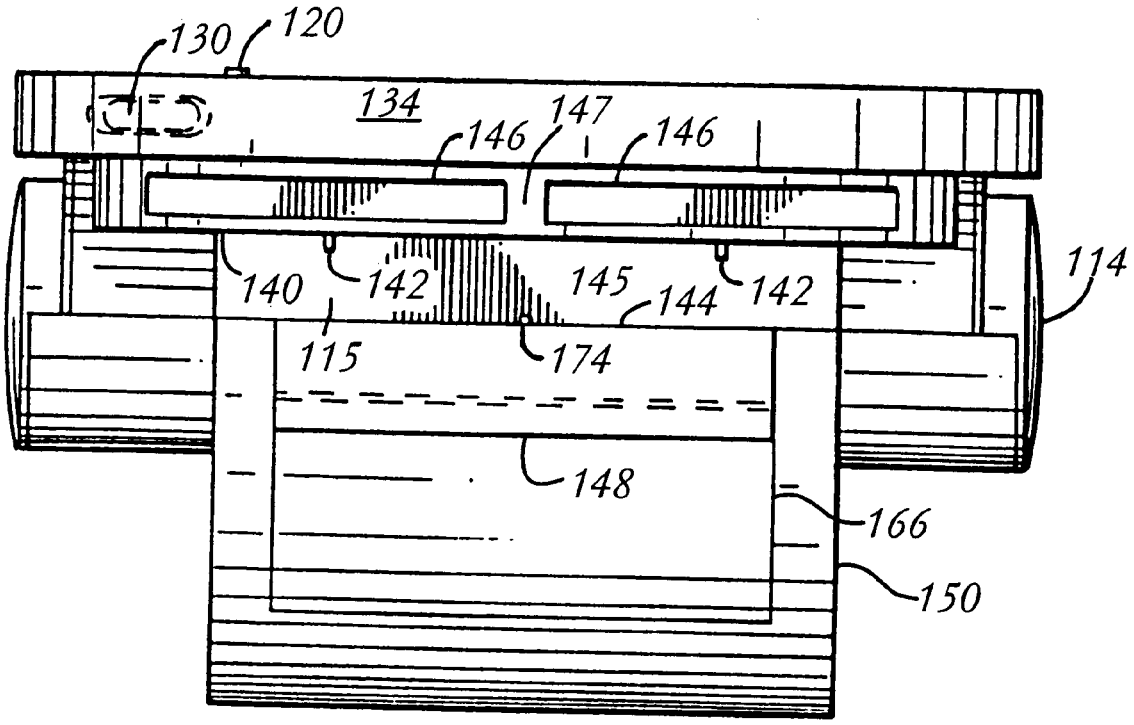
FIG. 8 is a view of the computer of FIG. 1 along a line 8—8 shown in FIG. 3.
Figure 17:
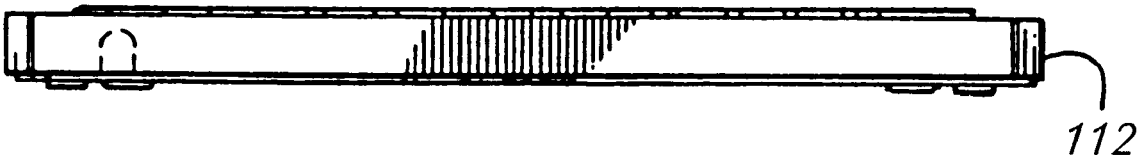
FIG. 17 is a rear view of the keyboard.

As shown in FIG. 7, one end of the keyboard connecting cord 113 is removably connected to the housing 102 of the computer 100 at a keyboard connecting cord port 138 on a rear surface 140 of the display screen portion. Preferably, the keyboard connecting cord port 138 is a modular jack-type connector. Similarly, FIG. 17 shows a rear surface of the keyboard 112 with a corresponding keyboard connecting cord port 138 into which the other end of the keyboard connecting cord 113 is inserted. In addition to or as a substitute for the keyboard 112, any other equivalent input device may be operatively linked to the housing 102. In addition, any other type of connection can be used, such as a hard-wire or infrared connection.

Figure 5:
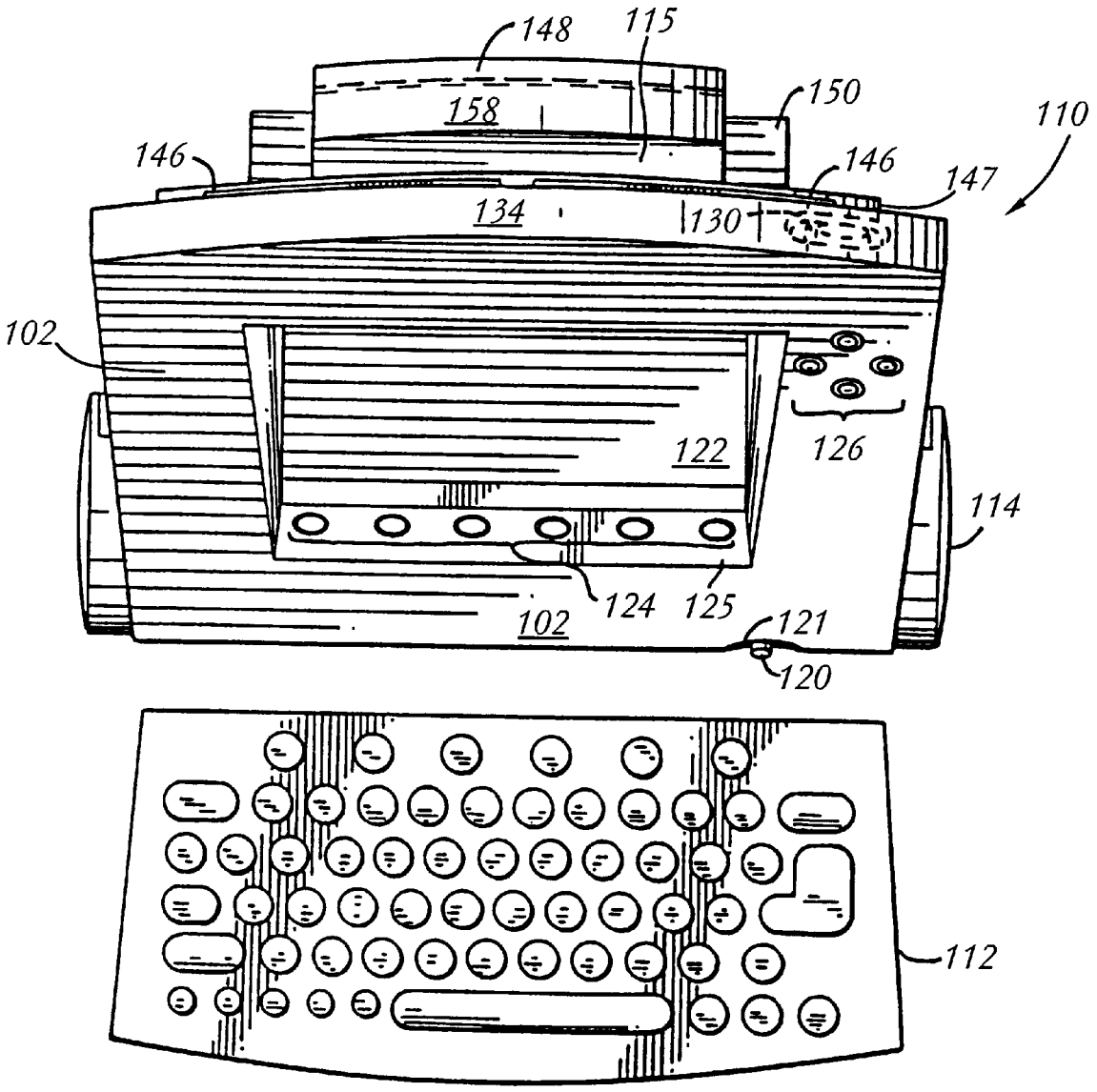
FIG. 5 is a top view of the computer and keyboard of FIG. 1.

As shown in FIGS. 2 and 5, a width of the keyboard 112 is slightly less than a width of the display screen 122. Further, a front surface of the keyboard 112 is slightly curved. The side and back surfaces of the keyboard 112 are flat, such that the keyboard 112 has a fan shape when viewed from above as shown in FIGS. 1 and 5. Similarly, a top surface 134 of the display screen portion 132 is slightly curved. The side surfaces 104 and the bottom surface of the display screen portion 132 are flat. The side surfaces 104 slope away from each other toward the display screen top surface 134. As a result, the display screen portion also has the fan shape.

A lower edge of the display screen portion 132 includes a grooved relief 121. A print control button 120 is positioned within the grooved relief 121. As shown in FIG. 27, the print control button 120 is electrically connected to the controller 210 of the control system 200. The print control button 120 includes a cylindrical body portion that projects upwardly and slightly beyond the grooved relief 121. As explained below in greater detail, when a user presses the print control button 120, the controller 210 outputs the file that is currently being displayed on the display screen 122 to the printer 118 and the printer 118 prints the file. As an alternative to the push-button configuration, the print control button 120 can be configured to operate as any other simple and easily operated control element. For example, the print control button 120 could be a solid state button, a mechanical button, a pressure sensitive switch, or any other switch.

In a preferred embodiment, pressing the print control button 120 generates a "print file" interrupt within the controller 210. In response, the controller 210 outputs the entire file, of which only a single screen is displayed at any one time, to the printer 118. Therefore, multiple keystrokes and/or repetitive. operations can be eliminated. As a result, a user can actuate the print control button 120 by pressing it once in a single operation instead of alternatingly pressing print screen and page down keys or accessing the print sequence of the program by stepping through a number of menu branches.

Figure 6:
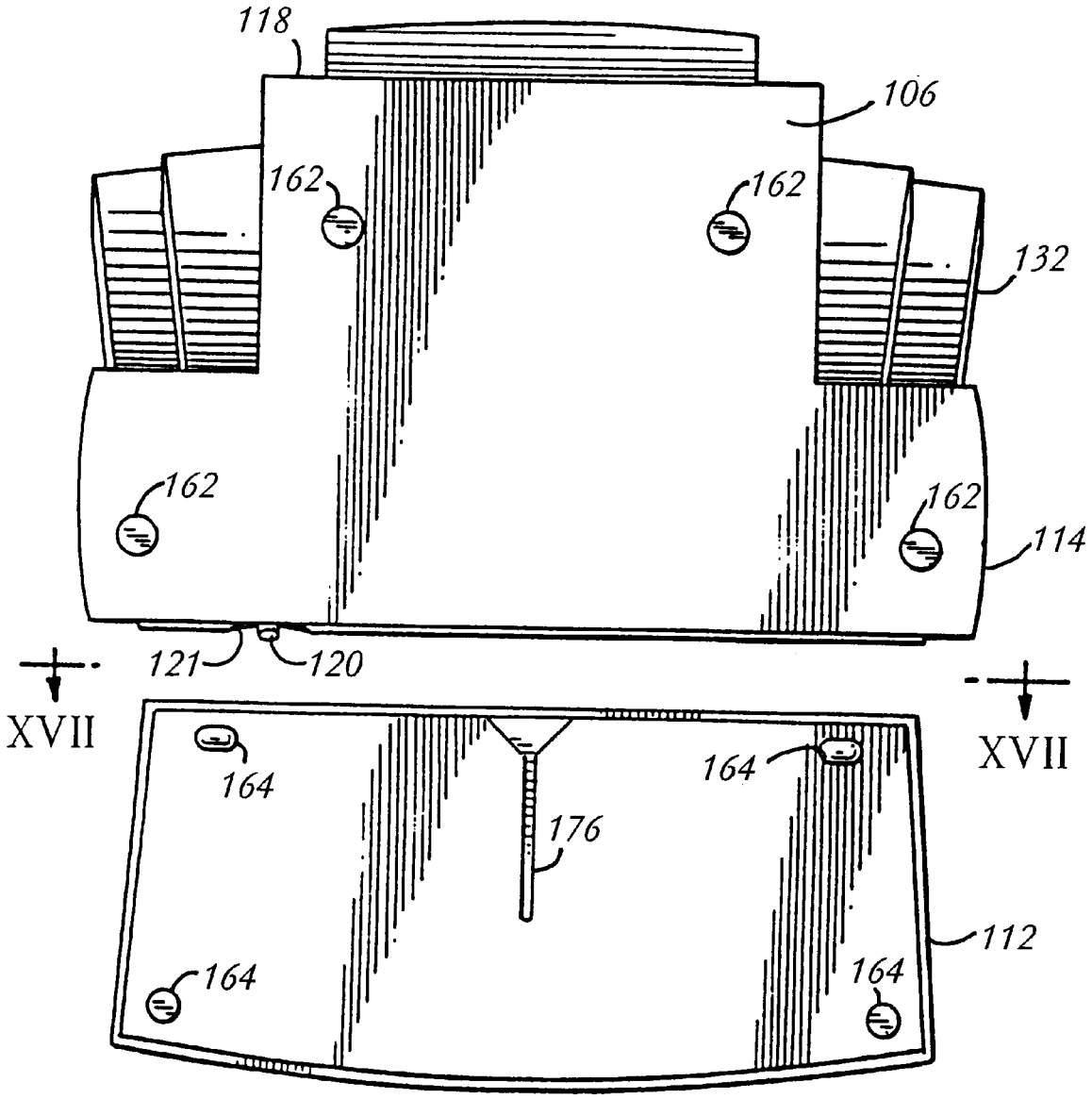
FIG. 6 is a bottom view of the computer and keyboard of FIG. 1.
Figure 18:
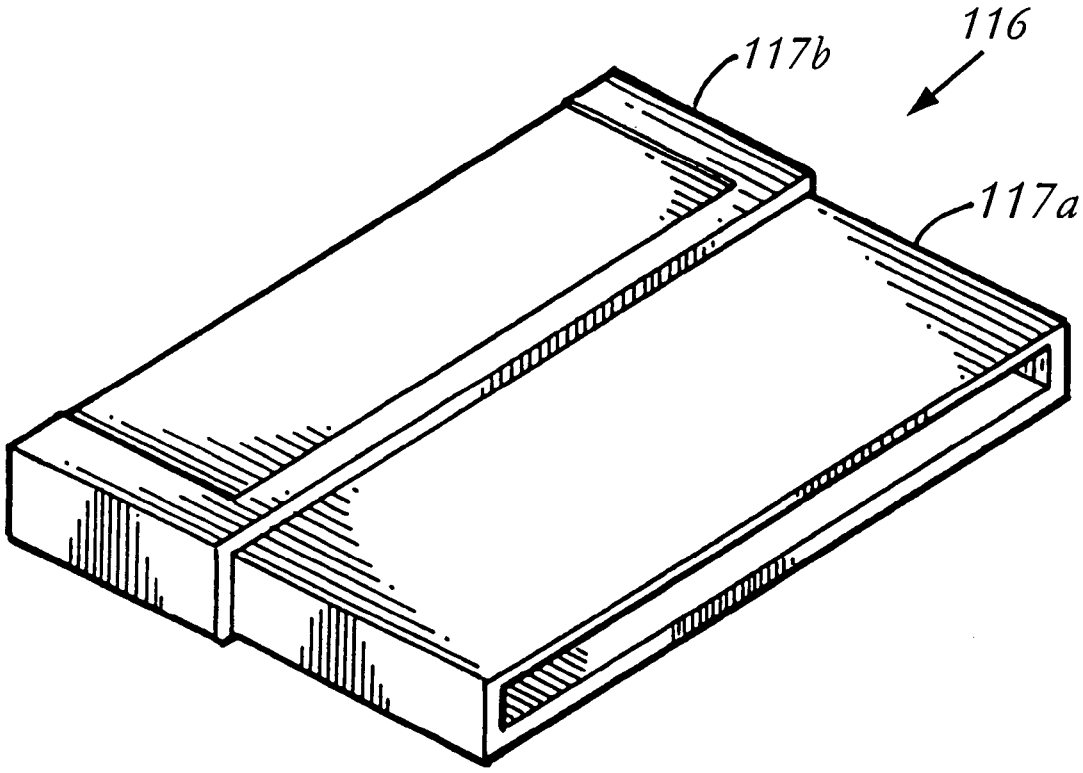
FIG. 18 is a front perspective view of the data storage element.

The computer 100 includes at least two removable data storage elements 116. The data storage elements 116 are preferably integrated circuit (IC) cards, but other media such as disks, diskettes, tape cassettes, etc. can be used. The data storage elements 116 are inserted into data storage element port 146, as shown in FIGS. 3, 4 and 6. Preferably the data element storage ports 146 are positioned in an intermediate upper surface 147 of the housing 102. As shown in FIG. 18, the data storage elements 116 preferably include insertion portions 117*a* and enlarged portions 117*b*. The data storage element ports 146 are dimensioned to receive the insertion portions 117*a*. Therefore, the enlarged portions 117*b* project outwardly from the data storage element ports 146 when the data storage elements 116 are fully inserted.

As shown in FIGS. 3, 4 and 7, the printer 118 includes a lower printer portion 150 and an upper printer portion 148. The upper printer portion 148, as explained in greater detail below, is pivotably connected to the lower printer portion 150. A printer top surface 158 of the upper printer portion 148 is slightly curved, similar to the display screen portion top surface 134. As shown in FIGS. 3 and 4, the lower printer portion 150 also has the fan shape when viewed from the side.

Figure 19:
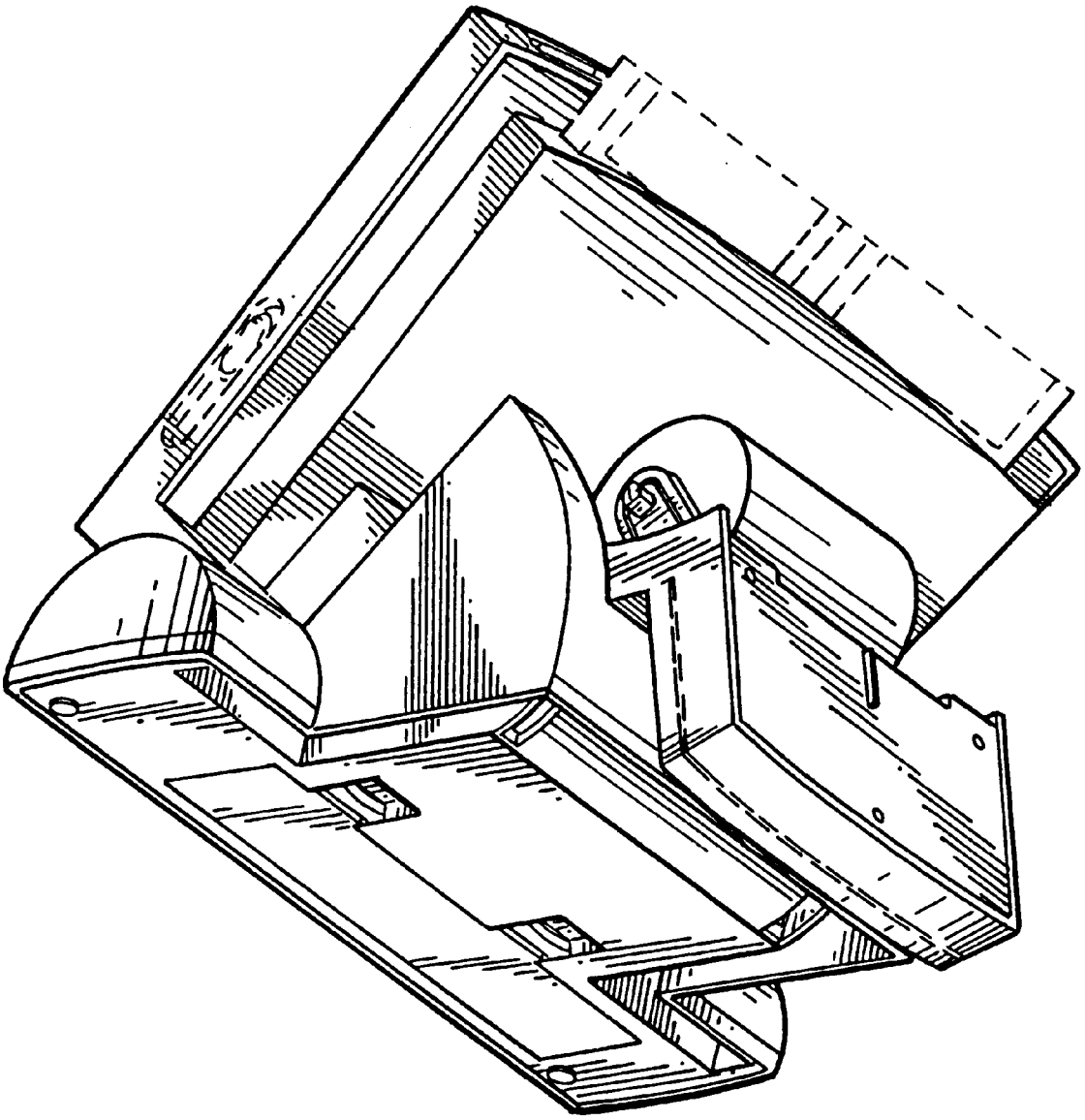
FIG. 19 is a rear perspective view of the computer showing the printer in a lowered position.
Figure 20:
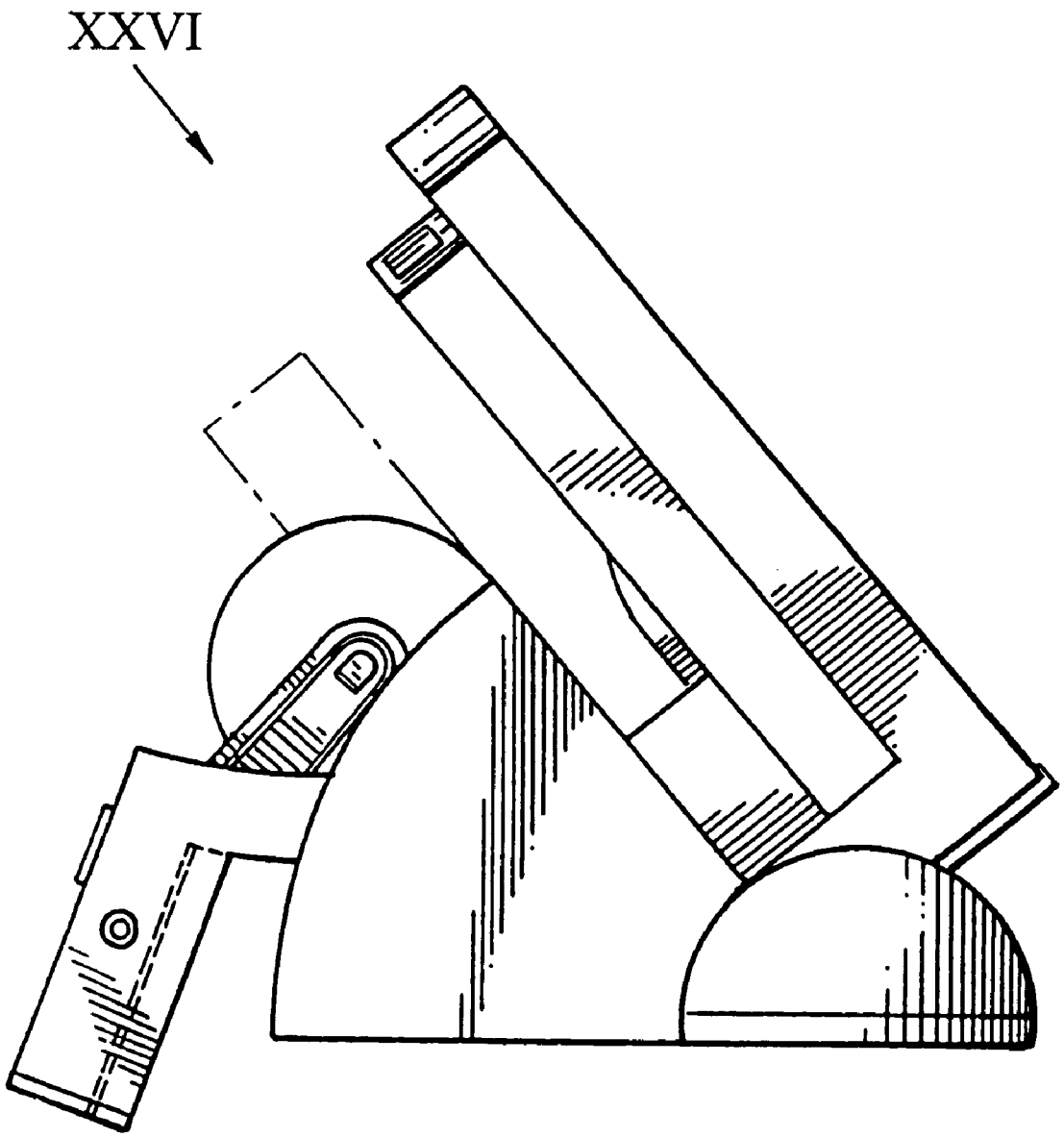
FIG. 20 is a left side view of the computer of the computer of FIG. 19 showing the pivot path of the printer between a raised operating position (shown in phantom) and a lowered loading/unloading position.
Figure 21:
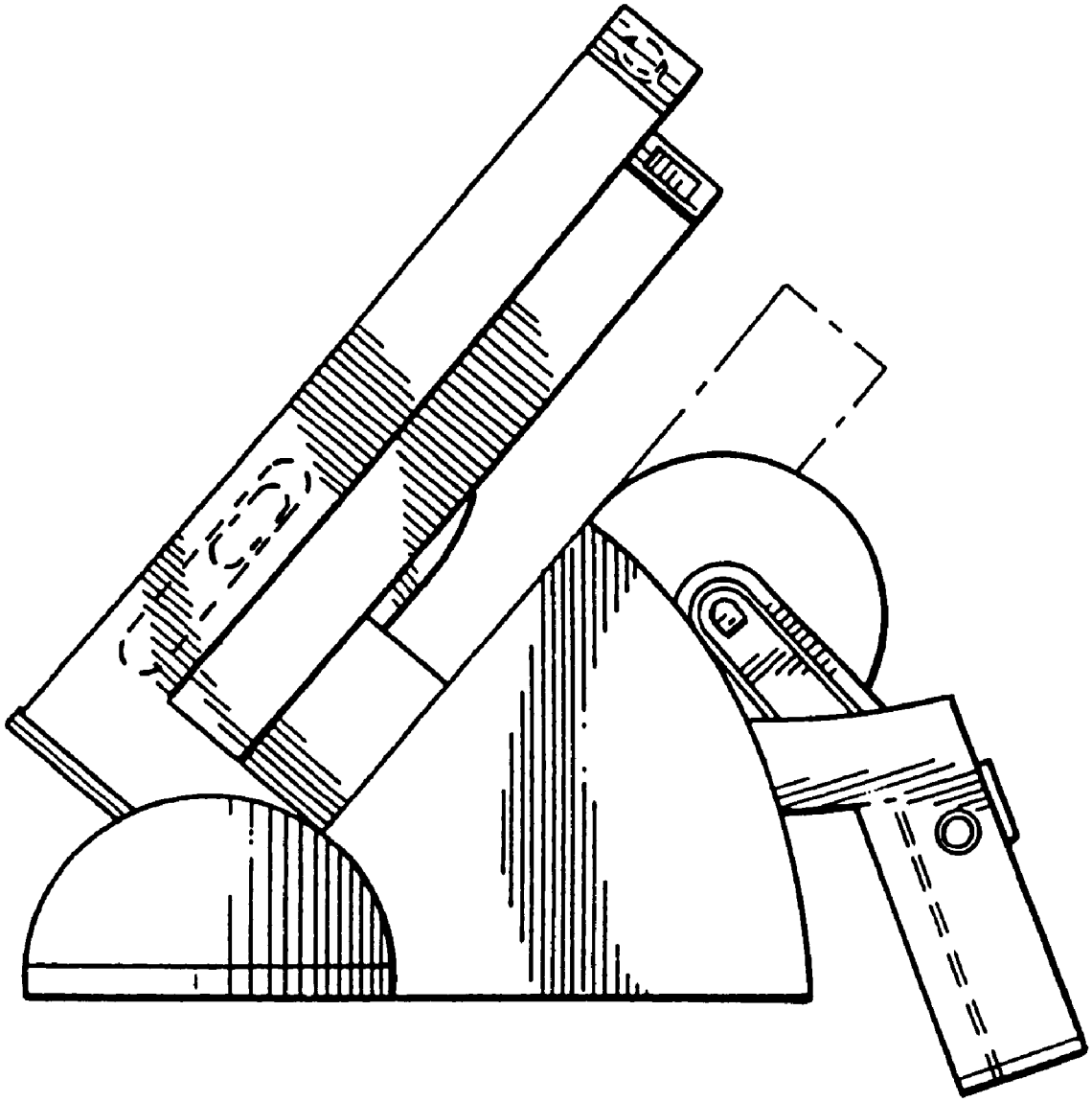
FIG. 21 is a right side view of the computer of FIG. 19.
Figure 23:
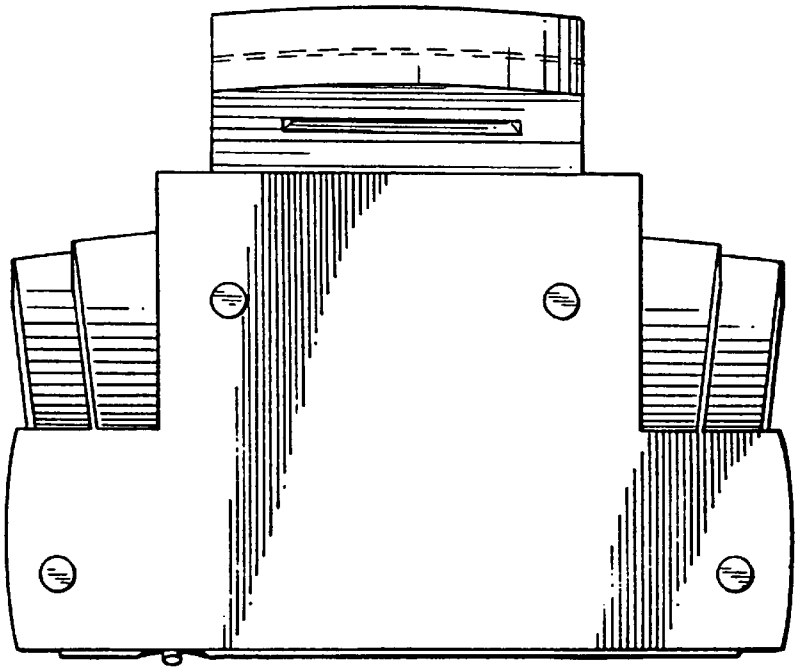
FIG. 23 is a bottom view of the computer of FIG. 19.
Figure 22:
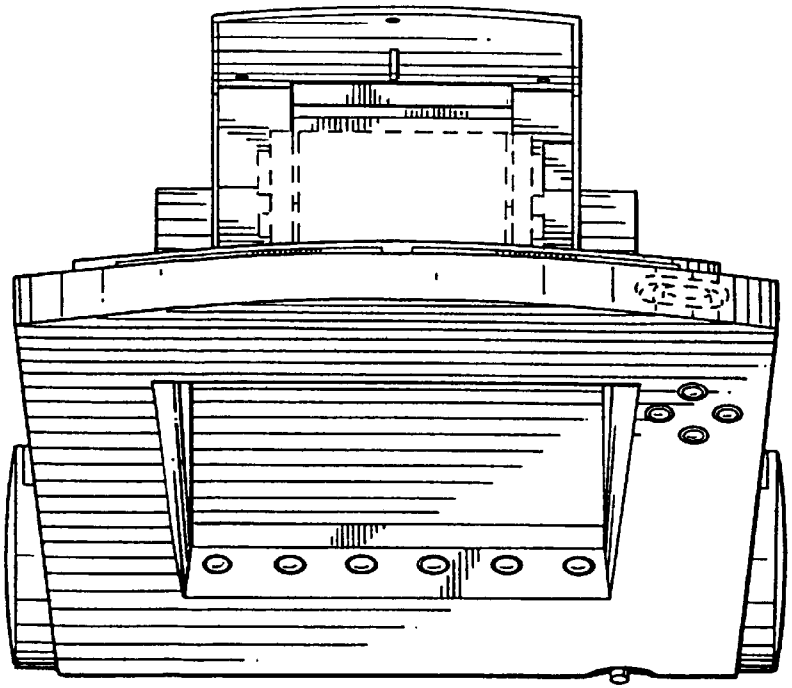
FIG. 22 is a top view of the computer of FIG. 19.
Figure 24:
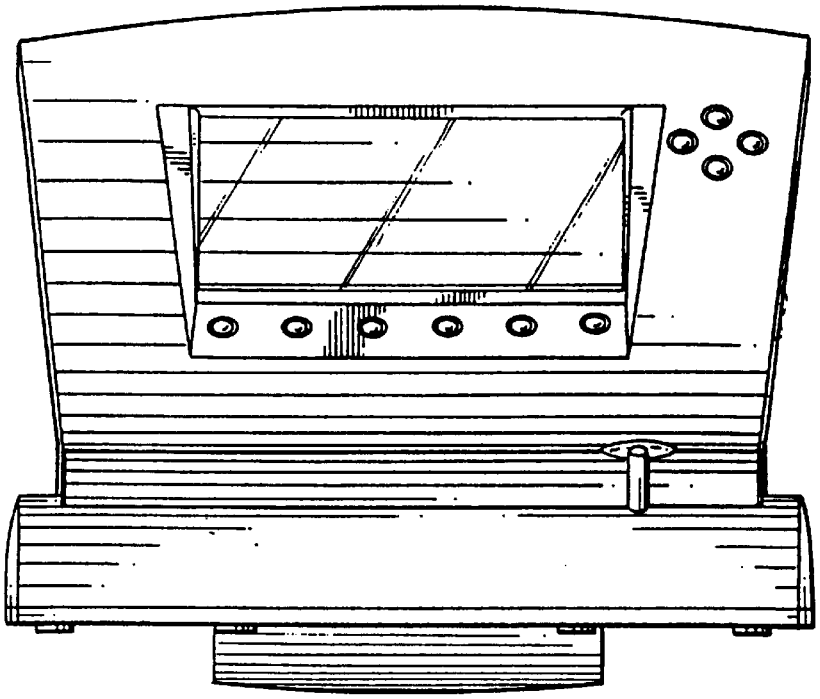
FIG. 24 is a front view of the computer of FIG. 19.
Figure 25:
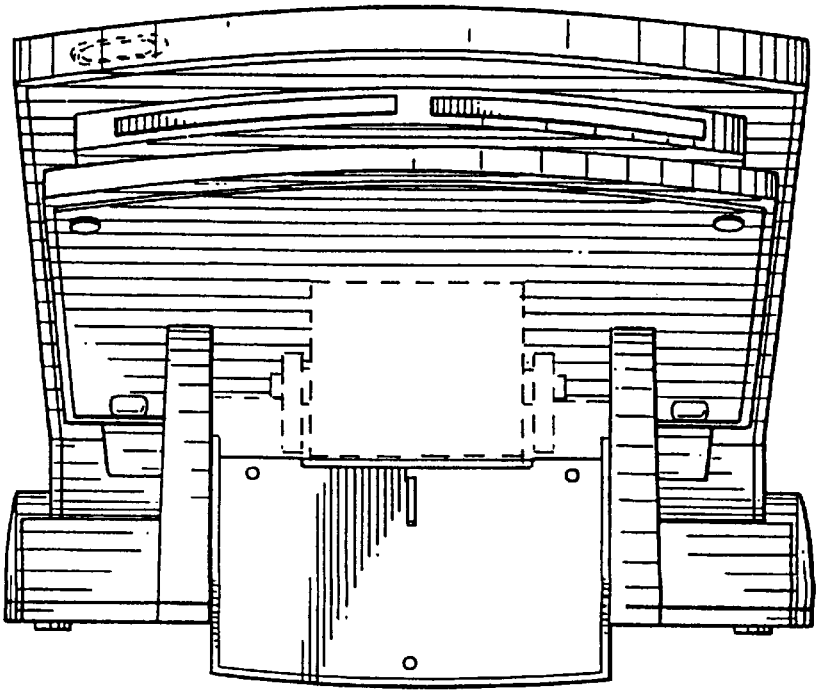
FIG. 25 is a rear view of the computer of FIG. 19.
Figure 26:
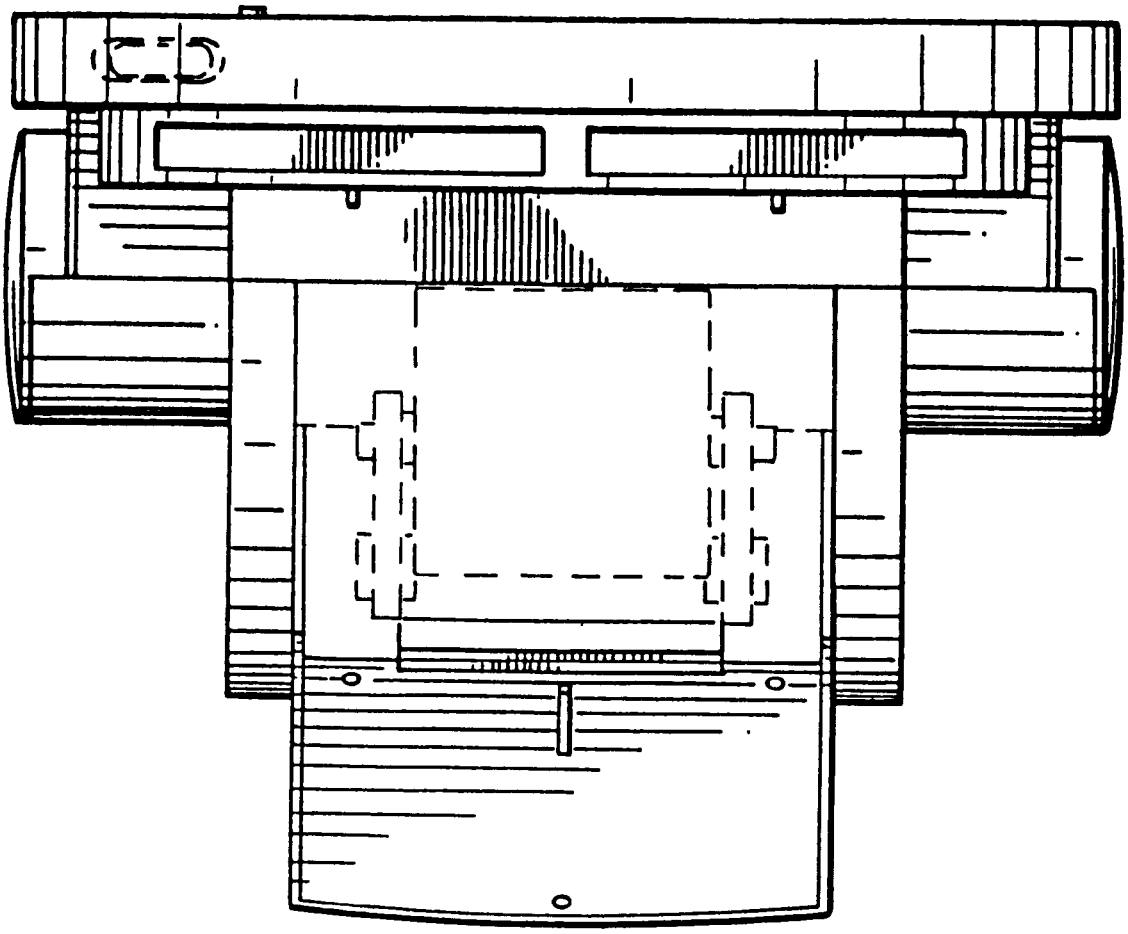
FIG. 26 is a view of the computer of FIG. 19 along a direction 26 as shown in FIG. 20.

As shown in FIG. 19, a bottom surface 106 of the housing 110 can include a cover 160 for a battery compartment. The cover 160 fits flush with the adjacent portions of the bottom surface 106 and is secured in place by biased retaining portions (not shown), as known in the art. A number of rubber feet 162 and 164 are attached to the bottom surface 106 of the housing 110 and a bottom surface of the keyboard 112, respectively, at two or more corners. The rubber feet 162 and 164 support the housing 110 and the keyboard 112 and to hold them in place on smooth surfaces.

Figure 9:
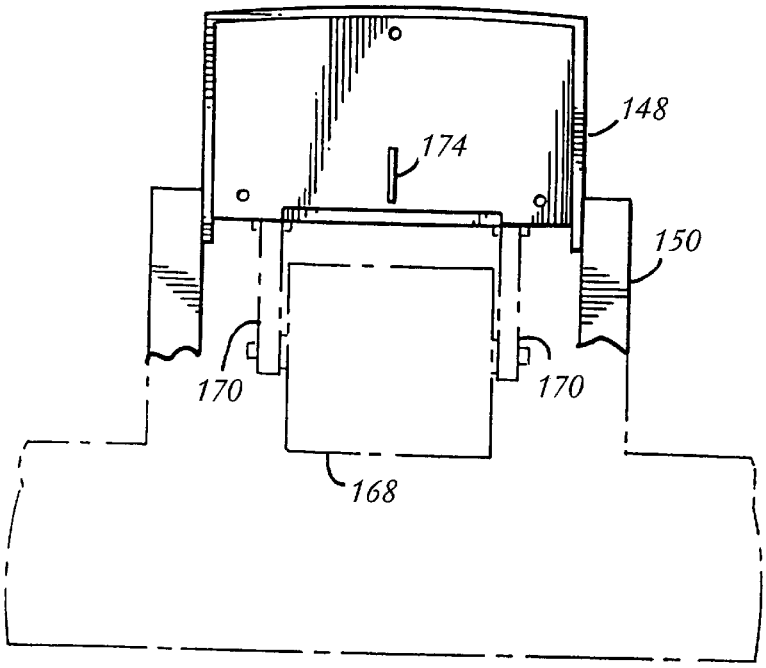
FIG. 9 is a view of the computer of FIG. 1 along a line 9—9 shown in FIG. 3.
Figure 10:
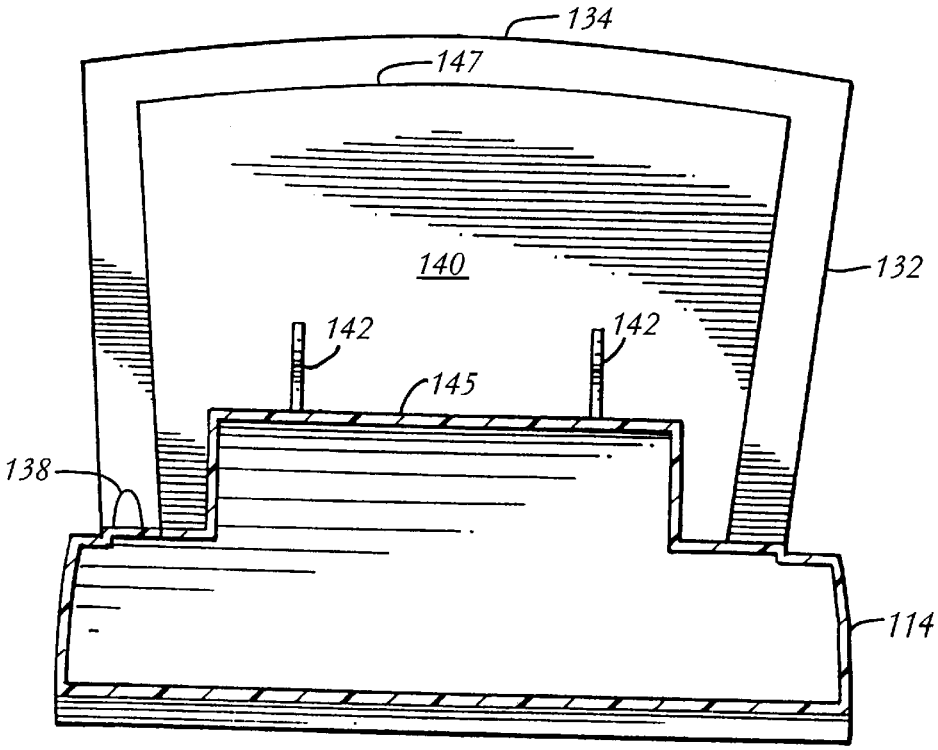
FIG. 10 is a view of the computer of FIG. 1 along a line 10—10 shown in FIG. 3.
Figure 11:
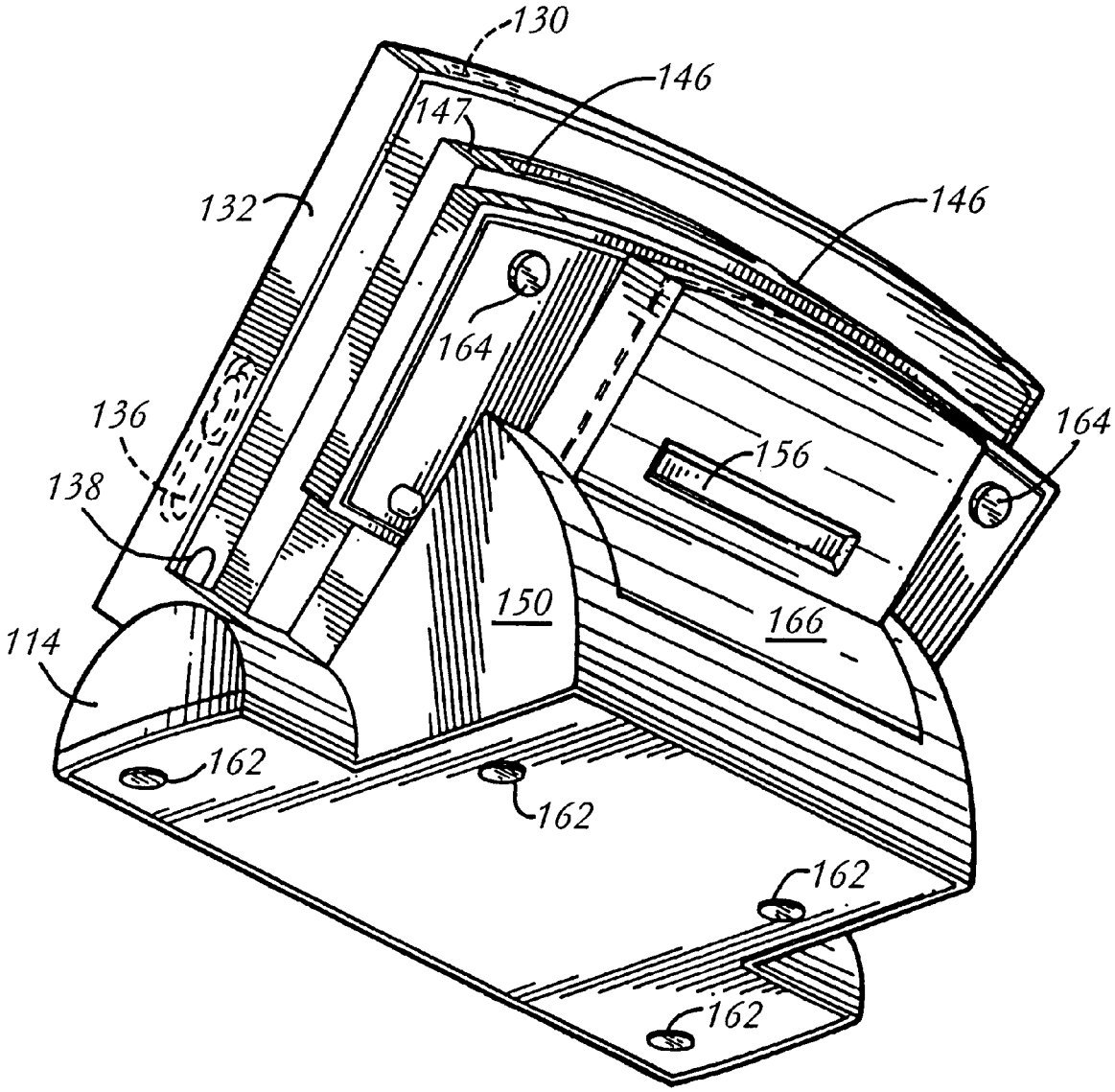
FIG. 11 is a rear perspective view of the computer with the keyboard in a storage position.
Figure 12:
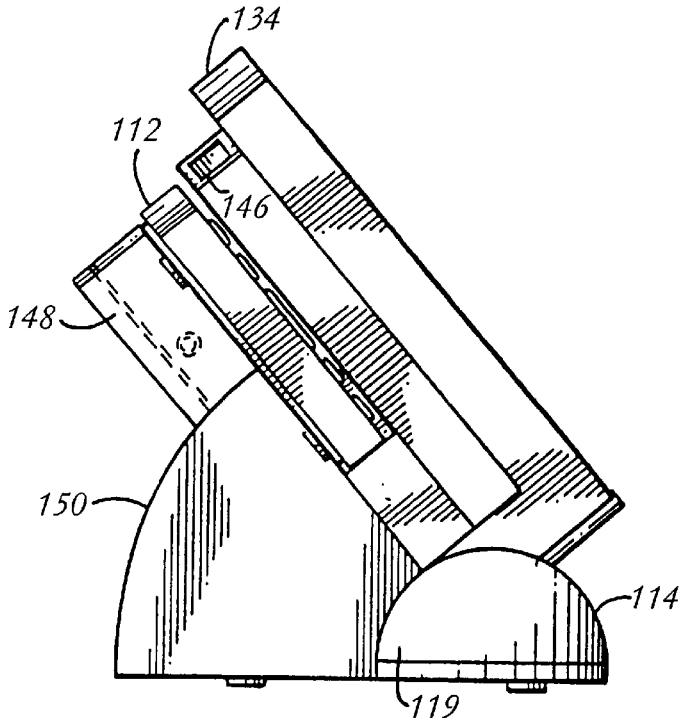
FIG. 12 is a left side view of the computer and keyboard of FIG. 11.
Figure 13:
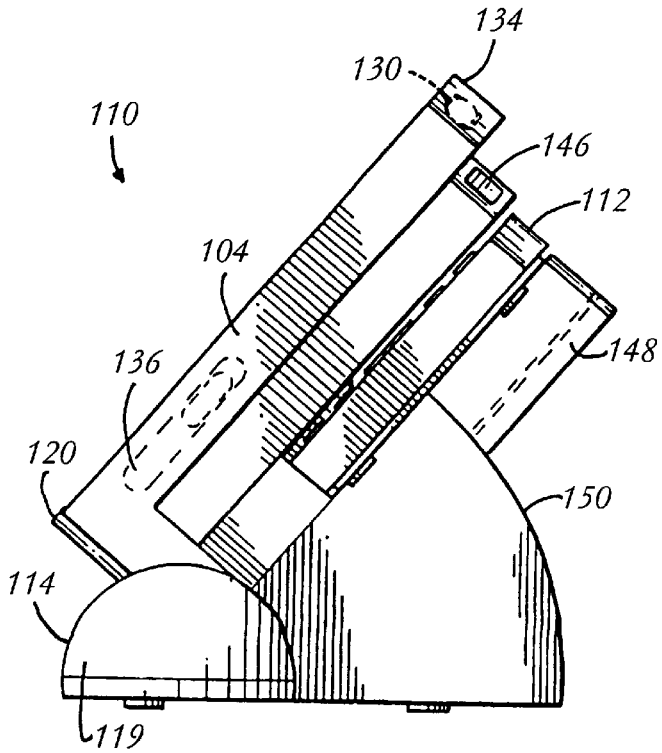
FIG. 13 is a right side view of the computer and keyboard of FIG. 11.
Figure 15:
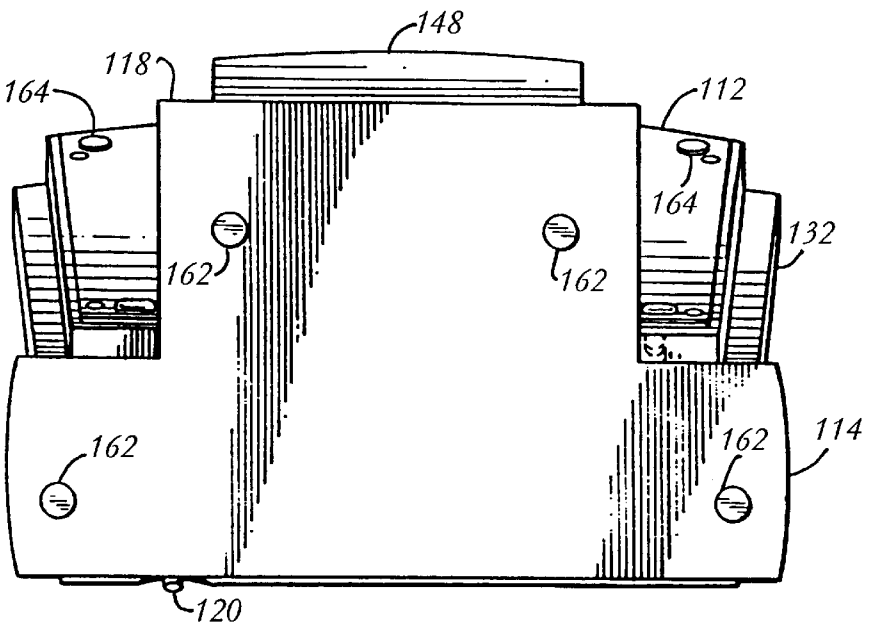
FIG. 15 is a bottom view of the computer and keyboard of FIG. 11.
Figure 14:
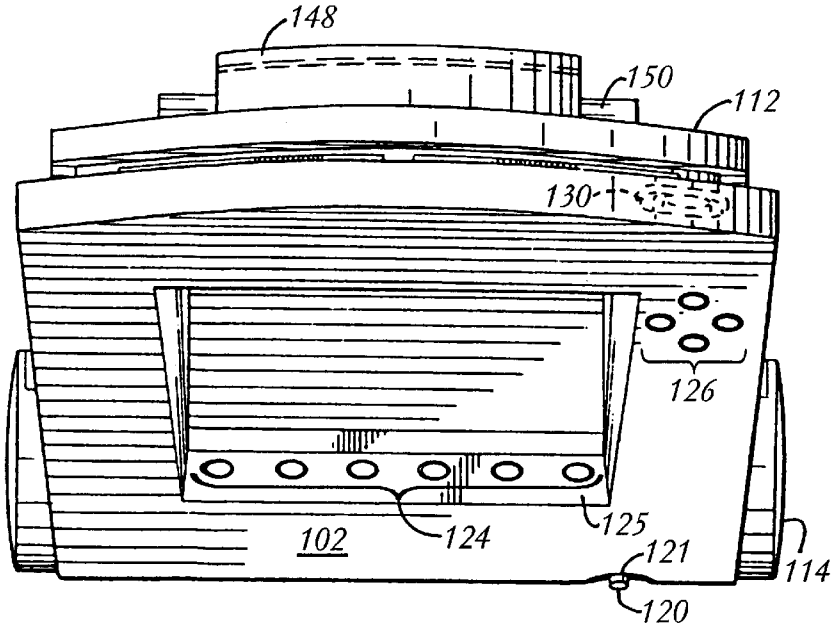
FIG. 14 is a top view of the computer and keyboard of FIG. 11.
Figure 16:
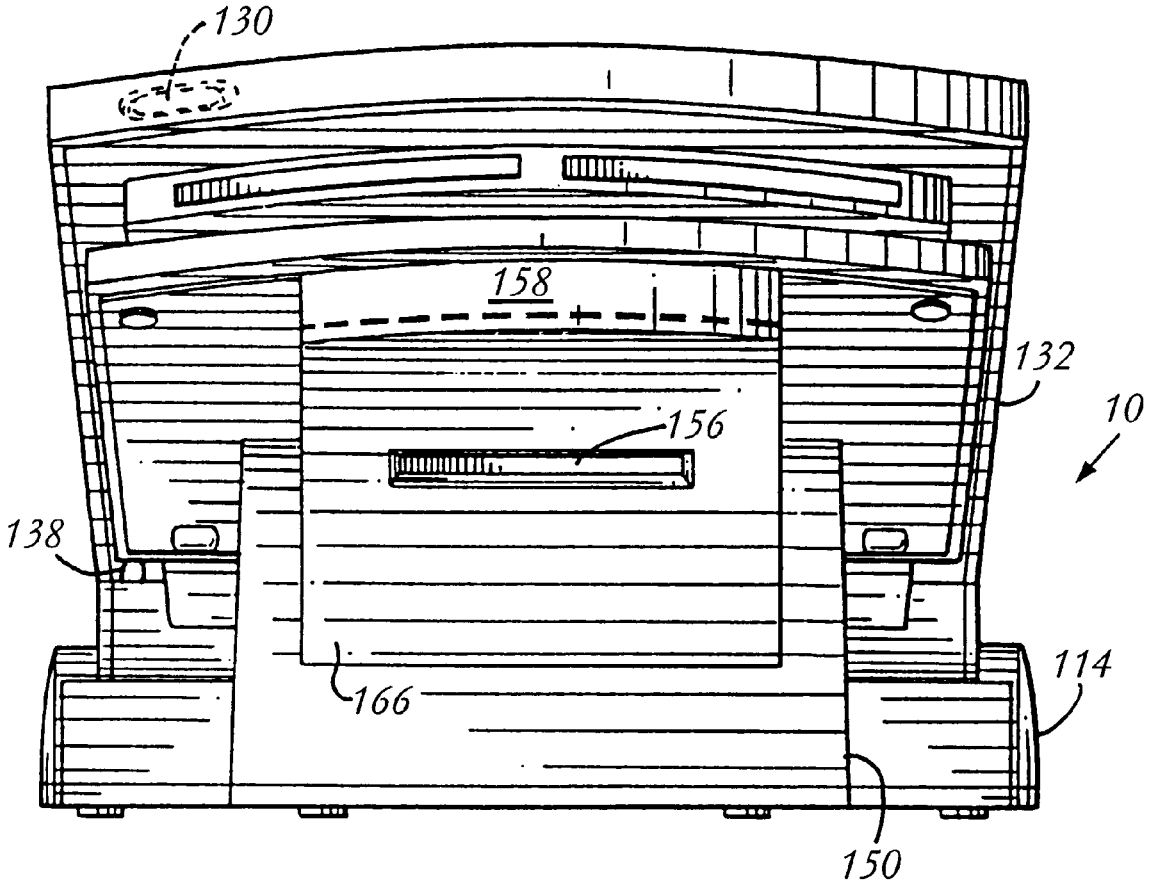
FIG. 16 is a rear view of the computer and keyboard of FIG. 11.

As shown in FIG. 6, the keyboard 112 includes a keyboard guide groove 176 extending inwardly from a rear surface of the keyboard 112. As shown in FIGS. 11 16, the housing 110 is configured to receive the keyboard 112, when placed into a keyboard storage position, within a keyboard storage portion 115 defined by the display screen portion rear surface 140, a printer major surface such as front surface 144 and positioned substantially parallel to the display screen portion rear surface an adjoining surface 145 that connects the rear surface 140 of the display screen portion 132 to the front surface 144 of the printer 118. According to a preferred embodiment, the keyboard storage portion 115 is configured to receive the keyboard 112 such that the rear surface of the keyboard 112 rests against the adjoining surface 145, the top surface of the keyboard 112 is adjacent the rear surface 140, and the bottom surface of the keyboard 112 is adjacent the front surface 144 of the printer 118. The keyboard guide groove 176 on the bottom surface of the keyboard 112 is dimensioned to receive a keyboard guide member 174, as shown in FIGS. 3, 4 and 9, attached to the front surface 144 of the printer 118.

At least two webs 142 project from the rear surface 140. The webs 142 are dimensioned to engage the front surface of the keyboard 112 (preferably between adjacent keys) such that the keyboard 112 is securely yet removably held within the keyboard storage portion 115. Therefore, the keyboard 112 is restrained from moving in a longitudinal direction of the keyboard storage portion 115 when the keyboard groove 176 engages the keyboard guide member 174. Further, the keyboard 112 is restrained from moving in a lateral direction by when the keyboard 112 engages the webs 142, as well as when the bottom surface of the keyboard 112 engages the front surface 144 of the printer 118.

The keyboard 112 can be placed in the keyboard storage portion 115 to free the work space in front of the housing 110, to protect the keyboard 112 from environmental conditions, for example, food spatters and the like if the computer 100 is used in the kitchen, and to facilitate storage and transport of the computer 100. Because the width of the keyboard 112 is less than the width of the display screen portion 132, the keyboard 112, when it is in the keyboard storage position, is concealed when the computer 100 is viewed from the front.

As described above, because the display screen function keys 124 and the display screen cursor movement keys 126 remain accessible to the user when the keyboard 112 is in the keyboard storage position, the user maintains control over most operations of the computer 100, particularly during execution of menu-driven programs requiring input only through the function key 124 or 128 or the cursor movement keys 126. Furthermore, the keyboard 112, when it is stored in the keyboard storage position, does not interfere with inserting or removing the data storage elements 116 from the data storage element ports 146 or the operation of the printer 118.

FIGS. 19–26 illustrate the upper printing portion 148 pivoted downward from the operating position shown, for example, in FIG. 3, to the loading/unloading position. The upper printing portion is held in the operating position until an upper printer portion release button 152 is depressed. The loading/unloading position allows the user to access a paper roll 168 and other components of the printer 118.

The upper printer portion 148 includes a known printer mechanism 169, preferably a Seiko Epson MTP Series thermal printing mechanism, although other printing mechanisms can be used. As shown in FIG. 27, the printer mechanism 169 is electrically connected to the controller 210 through a flexible connection link 185 and the bus 230. The controller 210 converts text data to bit map data for output to the printer 118. In addition to printing an entire file when the print control button 120 is pressed as described above, the printer 118 responds to other system (i.e., print screen) and software print commands, as is known.

During operation of the printer 118, the paper roll 168 rotates on paper roll supports 170 as the paper is drawn into the printer mechanism and fed outward through a paper exit opening 156, as shown in FIG. 7, in a rear printer panel 166. The paper exit opening 156 preferably includes a serrated edge to facilitate tearing a desired portion of printed paper from the paper roll 168. The rear printer panel 166 is removable and preferably formed of transparent plastic. The compact configuration and rearwardly oriented paper exit opening 156 of the printer 118 maintain the streamlined overall appearance of the computer 100. In addition, because printed paper exists rearward, it is protected from environmental conditions, such as food spatters when the computer 100 is used in a kitchen.

Although this invention is described in conjunction with specific embodiments thereof, many alternatives, modifications and variations will be apparent to those skilled in the art. Accordingly, the preferred embodiments of the invention as set forth above are intended to be illustrative, not limiting. Various changes to the invention may be made without departing from its true spirit and scope as defined in the following claims.

What is claimed is:

1. An information device having an attached printer and a keyboard, comprising:

a body having a bottom surface, a display screen side in which a display screen is positioned at an angle with respect to the bottom surface, and a printer side positioned opposite the display screen side having a keyboard storage portion shaped to at least partially receive the keyboard, said display screen having a first width extending from one side to another side; and a printer portion for housing the printer and a print medium attached to the printer side of the body and comprising a front major surface, a top surface substantially perpendicular to said front major surface and a rear surface, wherein said front major surface of said printer portion is positioned substantially parallel to said display screen such that a second width extending from one side to another side of the printer portion is less than the first width of the display screen when the information device is viewed from the display screen side.

2. The information device of claim 1, wherein the print medium is paper wound into a paper roll and the printer portion is configured to hold the paper roll such that the roll is rotatable about a paper roll axis.

3. The information device of claim 1, wherein the printer portion includes a movable upper section and a stationary lower section.

4. The information device of claim 3, wherein the upper section includes an exit opening through which the print medium exits.

5. The information device of claim 3, wherein the upper section includes a feed button actuatable to feed the print medium through the printer.

6. The information device of claim 3, wherein the upper section includes a printer mechanism of the printer.

7. The information device of claim 6, wherein the printer mechanism is operatively connected to a controller of the information device by a flexible connection link.

8. The information device of claim 6, wherein the printer mechanism is a thermal printing mechanism and the print medium is heat sensitive paper.

9. The information device of claim 3, wherein the upper section is pivotable about a pivot point on the lower section between a first position and a second position.

10. The information device of claim 9, wherein the upper section includes an upper section release button actuatable to release the upper section from the first position.

11. The information device of claim 9, wherein the upper section in the first position extends upward at an angle to a vertical direction.

12. The information device of claim 11, wherein the upper section in the first position defines a direction of a pre-printing feed path of the print medium from the lower section to the upper section of the printer portion.

13. The information device of claim 12, wherein a rear surface of the upper section includes an exit opening through which the print medium exits, and wherein a direction of the exit opening defines a post-printing feed path of the print medium that intersects the pre-printing feed path at an angle.

14. The information device of claim 9, wherein a roll of the print medium is exposed when the upper section is in the second position.

15. The information device of claim 1, wherein the body has a first vertical dimension defined by a distance between the bottom surface and an uppermost surface of the body and the printer portion has a second vertical dimension defined by a distance between the bottom surface and an uppermost surface of the printer, and wherein the second vertical dimension is less than the first vertical dimension.

16. The information device of claim 1, wherein said angle is about 45°.

17. The information device of claim 1, wherein the printer portion and the print medium remain concealed during operation of the printer when the information device is viewed from the display screen side.

18. An information device having a printer for printing information onto paper supplied from a paper roll and a keyboard operatively linked to the information device, the information device comprising:

a body having a front profile on a display screen side in which a display screen is positioned and a rear profile on a keyboard storage side having a keyboard storage portion shaped to at least partially receive the keyboard; and a printer portion enclosing the printer and the paper roll and attached to the keyboard storage side of the body, the printer portion comprising a front profile, a top profile substantially perpendicular to said front profile and a rear profile, wherein the front profile of the body is greater than the front profile of the printer portion viewed from the display screen side such that the printer portion is concealed from view.

19. An information device having an attached printer and a keyboard, comprising:

a body having a display screen side on which a display screen is positioned and a printer side positioned opposite the display screen side having a keyboard storage portion shaped to at least partially receive the keyboard, and a printer portion for housing the printer and a print medium attached to the printer side of the body, the printer portion comprising a front major surface, a top surface substantially perpendicular to said front major surface and a rear surface, wherein the rear surface of the printer portion includes an exit opening through which the print medium exits, and wherein the printer portion and the print medium remain concealed during operation of the printer when the information device is viewed from the display screen side.

* * * * *